US005127705A

United States Patent [19]

Antoine et al.

[11] Patent Number: 5,127,705

[45] Date of Patent: Jul. 7, 1992

[54] MULTIFUNCTION AND MULTIPOSITION CHAIR

[75] Inventors: Alain Antoine, Fraize; Gerard Lemaire, Nancy, both of France

[73] Assignee: Societe Salons Direct Usine, Fraize, France

[21] Appl. No.: 423,437

[22] PCT Filed: Dec. 14, 1988

[86] PCT No.: PCT/FR88/00609

§ 371 Date: Sep. 27, 1989

§ 102(e) Date: Sep. 27, 1989

[87] PCT Pub. No.: WO89/06923

PCT Pub. Date: Aug. 10, 1989

[30] Foreign Application Priority Data

Jan. 27, 1988 [FR] France ..... 88 01096

[51] Int. Cl.[5] ..... A47C 1/02

[52] U.S. Cl. ..... 297/68; 297/69

[58] Field of Search ..... 297/68, 69, 88, 89, 297/DIG. 10, 316, 320, 429

[56] References Cited

U.S. PATENT DOCUMENTS

| | | | |
|---|---|---|---|
| 2,322,683 | 6/1943 | Costa et al. | 297/69 |
| 3,095,235 | 6/1963 | Babcock et al. | 297/68 |
| 3,284,126 | 11/1966 | Piazza | 297/68 X |
| 3,406,772 | 10/1968 | Ahrent et al. | 297/69 X |
| 3,640,566 | 2/1972 | Hodge | 297/68 |
| 4,267,490 | 5/1981 | Thione | 297/68 X |
| 4,492,407 | 1/1985 | Broadhead | 297/68 X |

FOREIGN PATENT DOCUMENTS

| | | | |
|---|---|---|---|
| 3234836 | 3/1984 | Fed. Rep. of Germany | 297/68 |
| 2529456 | 1/1984 | France | 297/DIG. 10 |
| 1414175 | 11/1975 | United Kingdom | 297/68 |

OTHER PUBLICATIONS

Allen S. Hall, Jr. "Kinematics and Linkage Design" 1961 pp. 1-10.

*Primary Examiner*—Jose V. Chen

*Attorney, Agent, or Firm*—Weiser & Stapler

[57] ABSTRACT

An adjustable chair includes a back, seat, footrest, and support structure, the relative positions of which are adjustable by means of a single retractable jack. The chair includes a seat control mechanism comprising a central pivot and connecting rods extending therefrom to points on the back, seat, and support structure. A footrest control mechanism includes a linkage between the support structure and the footrest, and a spring causing compression between the footrest control mechanism and the seat.

9 Claims, 4 Drawing Sheets

MULTIFUNCTION AND MULTIPOSITION CHAIR

The present invention relates to a multifunction and multiposition chair which can be transformed automatically under the action of a jack into any intermediate position between a totally recumbent position and an orthostatic position for the user, of the type comprising a back, a seat and a footrest, the movements of displacement from one position to another being provided by a rod assembly which links the various elements to one another and forms a plurality of chains of the back, the seat and the footrest respectively.

A chair of this type has already formed the subject, by way of a nonlimiting example, of patent application Ser. No. EP 0,183,630.

This device is entirely satisfactory but it has been found that its operation can be improved still further.

The object of the present invention is to remedy this while preserving the practical usability of the previous embodiment.

According to the invention, this result is achieved with a multifunction and multiposition chair which can be transformed automatically under the action of a jack into any intermediate position between a totally recumbent position and an orthostatic position for the user, of the type comprising a back, a seat and a footrest, the movements of displacement from one position to another being provided by a rod assembly which links the various elements to one another and forms a plurality of kinematic chains sequentially providing the various movements of the back, the seat and the footrest respectively, which comprises respectively:

an assembly for controlling the footrest;

an assembly for controlling the seat;

an assembly for controlling the mechanism for positioning the back and for maintaining said back in the vertical position, which acts on an underframe complementary to said seat, it being possible for the footrest to be totally retracted in the intermediate sitting and vertical position and to form the extension of the seat and the back in the horizontal position.

The invention will be better understood with the aid of the following description of a preferred embodiment, with reference to the accompanying schematic drawings which illstrate the various kinematic chains in side views in which:

FIG. 5 is a general view in the upright position with

Figure 5A:
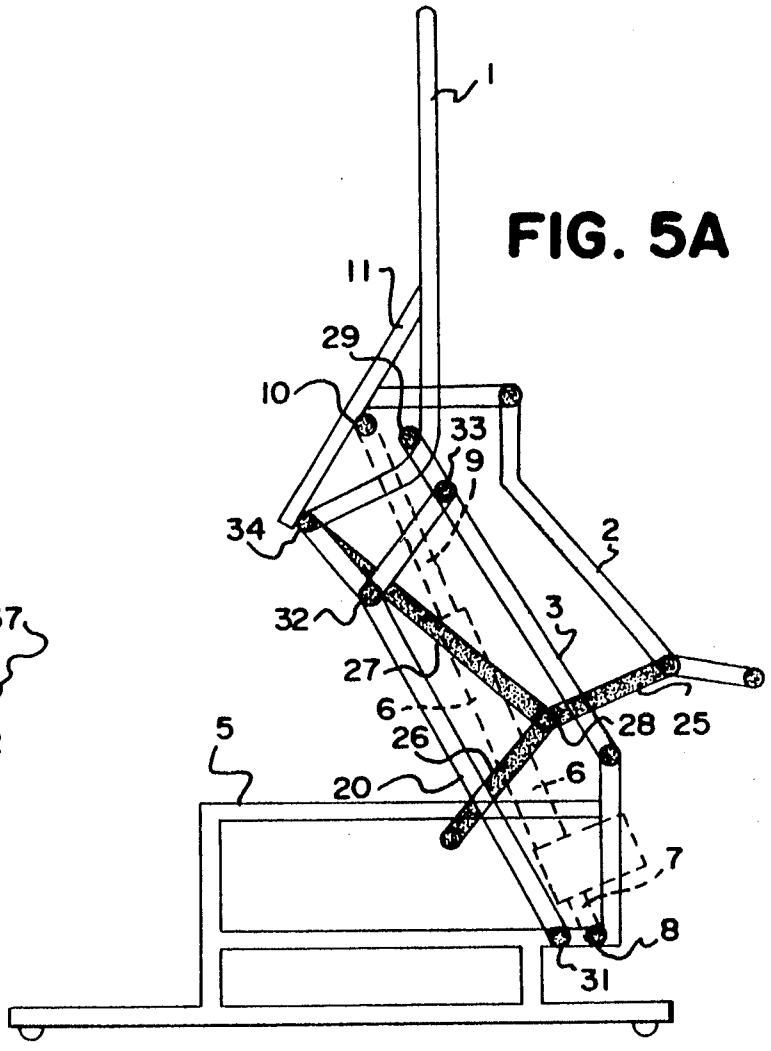
Figure 5:
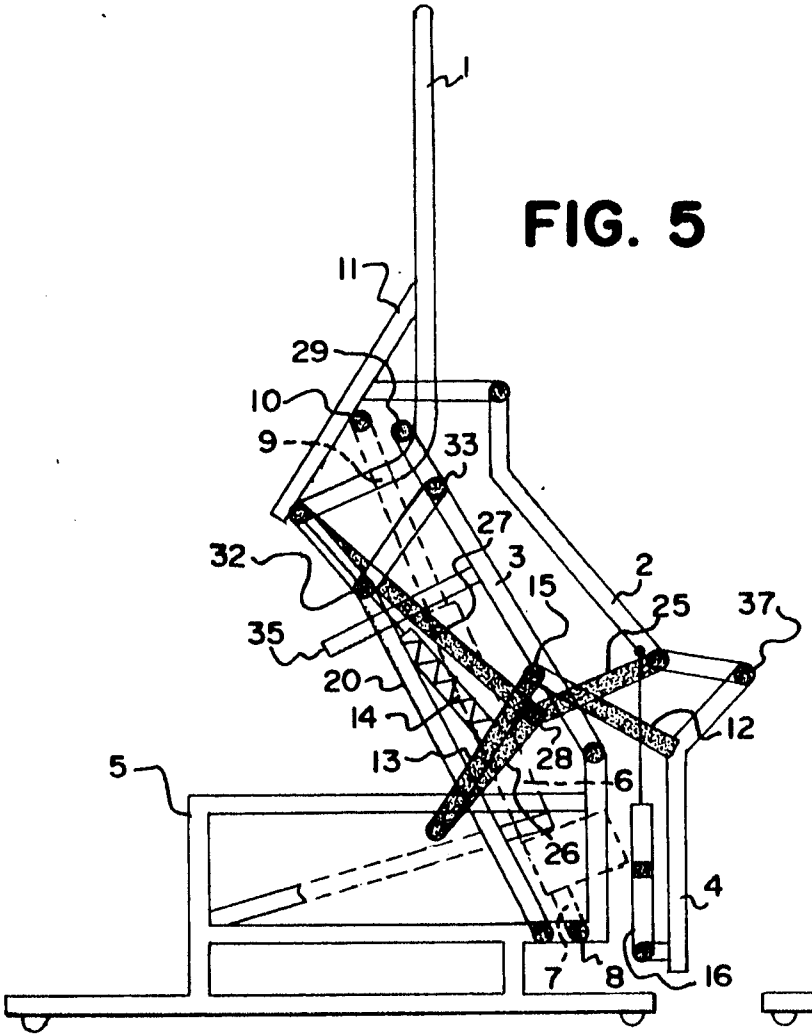
Figure 5B:
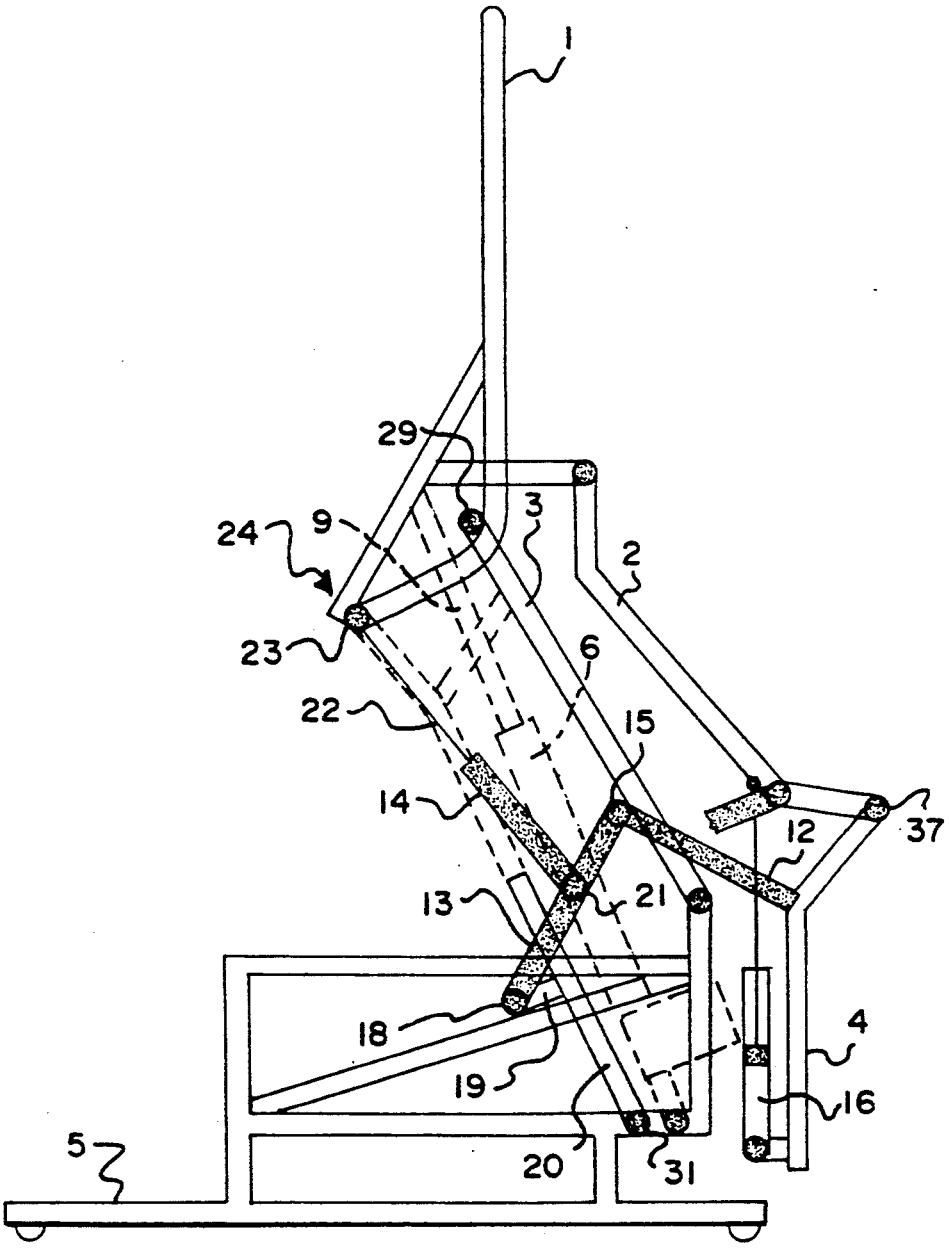

FIG. 5A illustrating the mechanism which provides the positioning of the back and of the seat and from which the footrest mechanism has been omitted; and FIG. 5B illustrating the mechanism which provides the positioning of the footrest.

In the text which follows, reference will be made to the figures collectively, without this being expressly mentioned.

The chair according to the invention is composed essentially of:

a back (1);

a seat (2);

an underframe (3);

a footrest (4);

a supporting structure (5).

These various elements are shown more particularly in FIGS. 5A and 5B.

Figure 1:
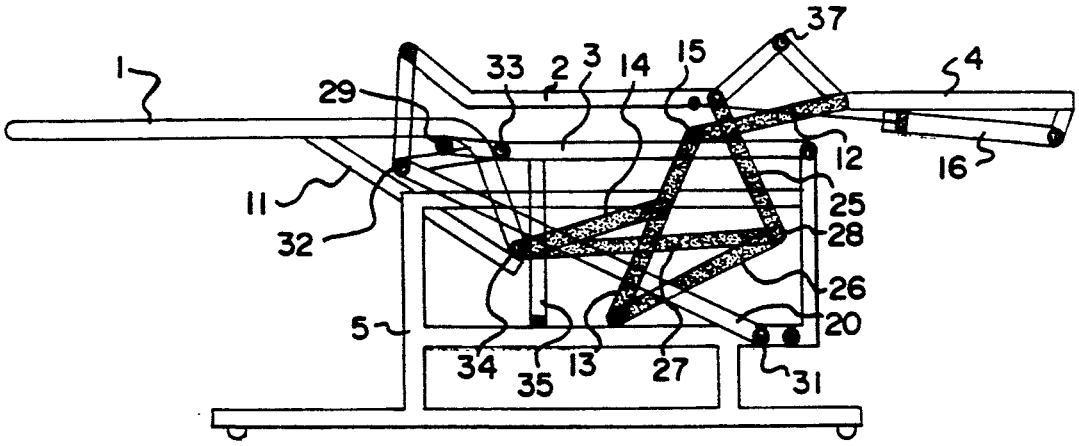
FIG. 1 is a view in the totally recumbent position.
Figure 2:
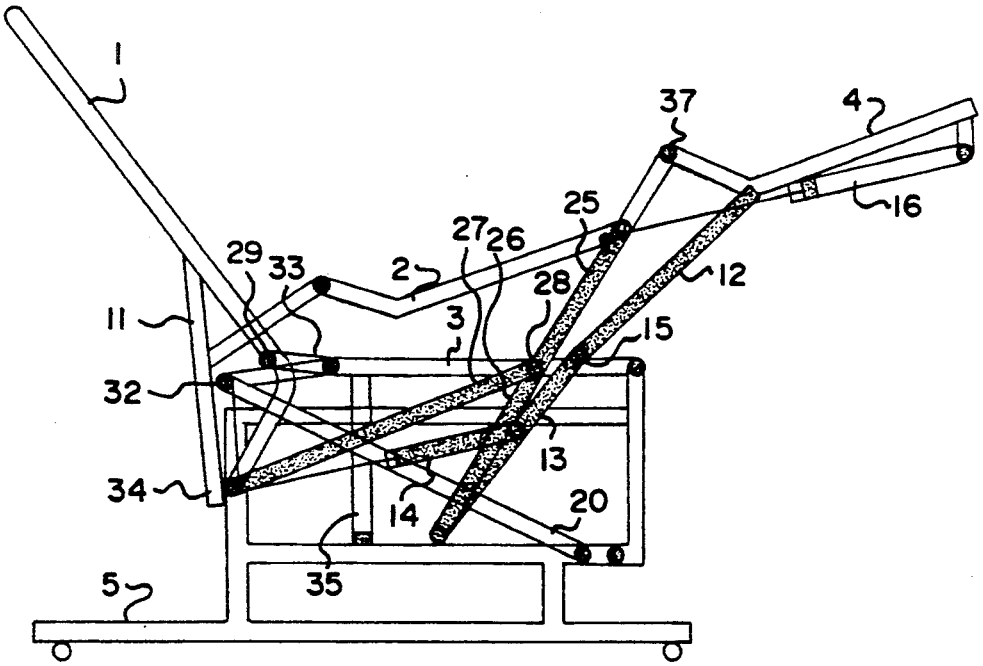
FIG. 2 is an intermediate view between the recumbent position and the sitting position.
Figure 4:
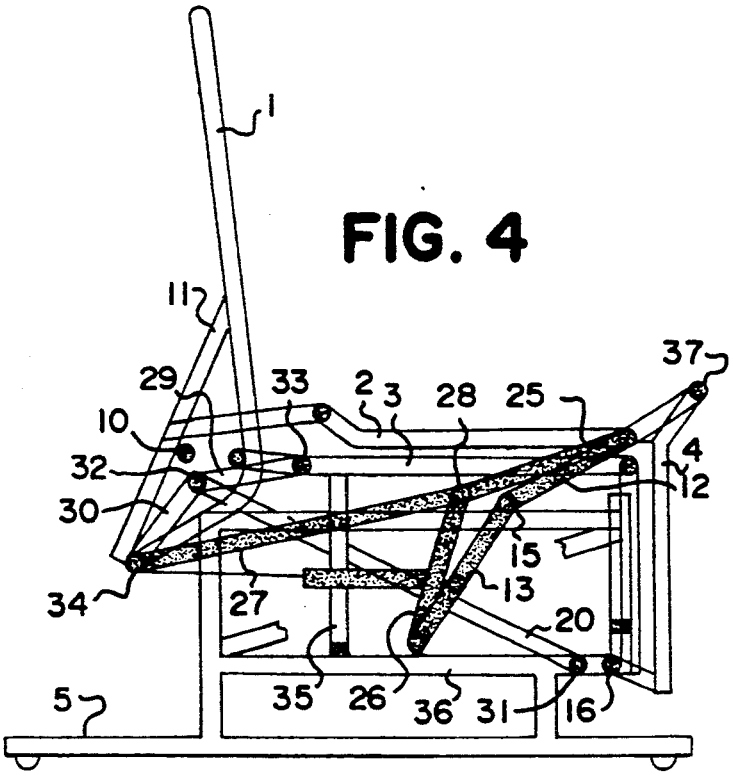
FIG. 4 is a view in the sitting position.

It is designed to be displaced between a plurality of positions between the recumbent position shown in FIG. 1 and the orthostatic position shown in FIG. 5, through all the intermediate positions and in particular the sitting position shown in FIG. 4.

All these displacements and the maintaining in the fixed position are provided by a single control jack (6), the strap (7) of which is fixed and articulated on the supporting structure (5) at a point (8) situated towards the front of the chair and the slide (9) of which is linked by a distal articulation at (10) to a brace (11) of the back (1).

The jack is controlled by a control box operated by the user, or a third party, and provides all the various displacements.

The mechanism for controlling the footrest consists essentially of two small connecting rods (12, 13) and a spring (14).

Figure 3:
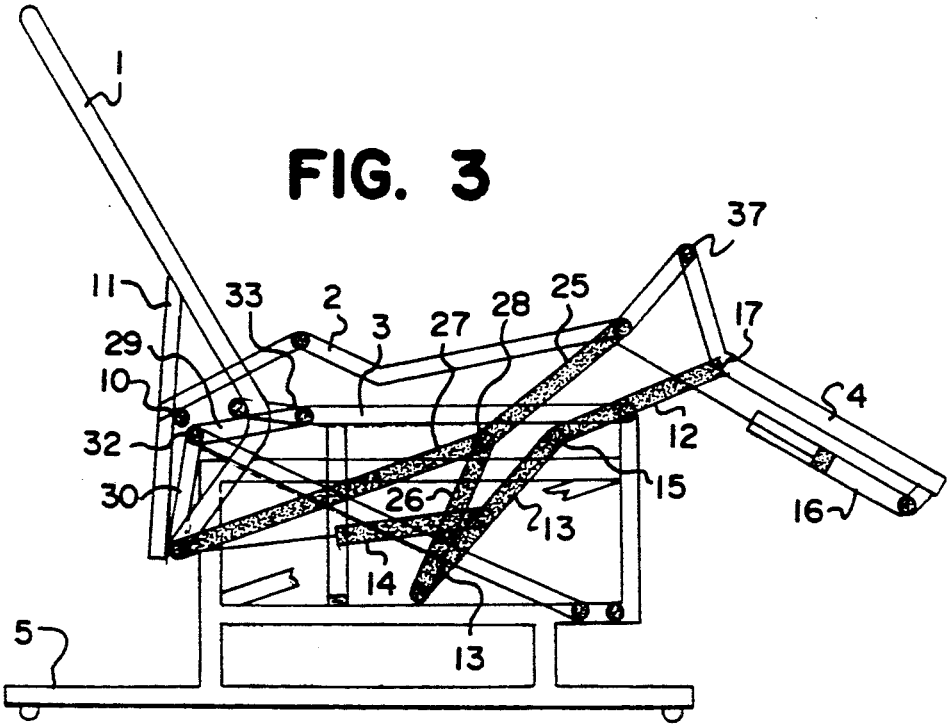
FIG. 3 is a subsequent intermediate view between the recumbent position and the sitting position.

As shown in FIG. 3, it will be noted that the small connecting rods (12, 13) are articulated to one another at a point (15). Moreover, the small connecting rod (12) for receiving the footrest is articulated at (17) on the frame (16) forming the footrest (4) whereas, at its other end, the small connecting rod (13) for controlling the footrest is articulated at (18) on a projection (19) integral with a central connecting rod (20).

On the bearing surface of the small connecting rod (13), there is fixed (at 21) the strap of the spring (14), the stem (22) of which is articulated at (23) on the rear member (24) of the back.

The mechanism for controlling the seat (2) consists essentially of three small connecting rods (25, 26, 27) which are articulated at a central point (28) and articulated, at their other ends, respectively as follows:

small connecting rod (25) for receiving on the seat, at the frontal axis (38) of the seat;

the small connecting rod (26) for controlling the seat, at (18) to the abovementioned part (19);

the small connecting rod (27), on the rear member (24) of the back.

The mechanism for controlling the positioning of the back and for maintaining the back in the vertical position is composed essentially of:

a central connecting rod (20);

two small connecting rods (29, 30).

The central connecting rod (20) is articulated at one of its ends (31) on the supporting structure (5) and at its other end at a point (32) to the two small connecting rods (29, 30).

At its other end the small connecting rod (29) is articulated at (33) on the underframe (3). The central connecting rod (20) and the underframe (3) together form a "parallel arm" type of interconnection between their respective pivot points on support structure 5 and the pivot points associated with the back member (1), as can be clearly seen in FIG. 5A.

At its other end, the small connecting rod (30) is articulated at (34) on the rear member (24) of the back.

The underframe (3) comprises a mechanical stop (35) which is arranged substantially perpendicular to the latter and abuts, from the sitting position to the recumbent position, against a horizontal member (36) of the supporting structure.

The spring (14) which maintains the footrest in the opened-out position is transformed, from the position of maximum extension of the slide, into a small rigid connecting rod.

Finally, the footrest is articulated at (37) with respect to the seat.

It will be understood that only the elements essential for the kinematic understanding of the invention have been shown and described. The other functional elements are accessible to a person skilled in the art.

We claim:

1. A multifunction and multiposition chair which can be transformed automatically under the action of a jack into any intermediate position between a totally recumbent position and an orthostatic position for the user, of the type comprising a support structure, a back, a seat and a footrest, movements of displacement from one position to another being provided by rod assemblies linking the back, seat, and footrest to one another to form a plurality of kinematic chains providing the movements of the back, the seat and the footrest, comprising:

an assembly for controlling the footrest;

an assembly for controlling the seat; and an assembly for controlling the back and for maintaining said back in a vertical position, which acts on an underframe complementary to said seat, wherein the footrest is fully retractable to intermediate sitting and vertical positions for forming an extension of the seat and the back in a horizontal position;

wherein the plurality of kinematic chains are controlled by a single control jack having a strap fixed and articulated on the support structure and a slide linked by a distal articulation to a brace on the back.

2. The chair as claimed in claim 1, wherein the assembly for controlling the footrest includes two connecting rods and a spring, the connecting rods being articulated to one another, and wherein one connecting rod is articulated on the frame at one end and, at another end, is articulated on a projection integral with a central connecting rod, and further having a bearing surface fixed to the spring, the spring having a stem articulated on the back.

3. The chair as claimed in claim 2, wherein the spring is transformable into a small rigid connecting rod when fully extended.

4. The chair as claimed in claim 1, wherein the assembly for controlling the seat includes first, second, and third connecting rods which are articulated at a central point and wherein:

the first connecting rod is articulated on an axis of the seat;

the second connecting rod is articulated on the projection integral with the central connecting rod, and the third connecting rod is articulated on the back.

5. The chair as claimed in claim 1, wherein the assembly for controlling the back and for maintaining the back in the vertical position includes:

a central connecting rod; and fourth and fifth connecting rods, wherein the central connecting rod is articulated at one end on the support structure and at another end to the fourth and fifth connecting rods of the assembly for controlling the footrest, and wherein the fourth connecting rod is articulated at an end thereof on the underframe, and wherein the fifth connecting rod is articulated at an end thereof on the rear member of the back.

6. The chair as claimed in claim 1, wherein the underframe includes a mechanical stop adapted to abut against a horizontal member on the supporting structure.

7. An adjustable chair, comprising:

a support structure;

a back member mounted by first pivot means to the support structure, and further including a first extension rigidly mounted on the back member opposite the first pivot means, and a first brace extending from the back member;

a seat member, mounted at a first end by second pivot means to the first brace and having at a second end a first axis and a third pivot means, the first axis being disposed between the second pivot means and the third pivot means;

a footrest member, mounted to the second end of the seat member by the third pivot means and including a second axis disposed between the first end of the footrest member and a distal end of the footrest member;

a seat control mechanism having a central pivot and first, second, and third connecting rods pivotally extending therefrom, the first rod being pivotally mounted to the first extension on the back member, the second rod being pivotally mounted to a fixed point on the support structure, and the third rod being pivotally mounted to the first frontal axis on the seat member;

a footrest control mechanism, having a first end pivotally mounted to the fixed point on the support structure, a second end pivotally mounted to the second axis on the footrest member, and a pivotable joint therebetween, and further including means for causing compression between the first extension of the back member and a point on the footrest control mechanism between the pivotable joint and the fixed point on the support structure;

a second means mounted between a point on the seat member and a point on the footrest member, for causing compression therebetween; and a retractable control jack operatively disposed between a first jack pivot point on the support structure and a second jack pivot point mounted on the back member, whereby the relative positions of the back member, seat member, and footrest member are variable by means of extension and retraction of the control jack.

8. An adjustable chair, comprising:

a support structure;

a parallel arm interconnection including an underframe member pivotally mounted on the support structure, and a central connecting rod pivotally mounted on the support structure;

a back member, mounted by first pivot means to the underframe, further including a first extension rigidly mounted on the back member opposite the first pivot means, the distal end of the first extension being pivotally mounted to the central connecting rod at a second pivot means, and a first brace extending from the back member;

a seat member, mounted at a first end by third pivot means to the first brace and having at a second end a first axis and a fourth pivot means, the first axis being disposed between the third pivot means and the fourth pivot means;

a footrest member, mounted to the second end of the seat member by the fourth pivot means, and including a second axis disposed between the first end of the footrest member and a distal end of the footrest member;

a seat control mechanism, having a central pivot and first, second, and third connecting rods pivotally extending therefrom, the first rod being pivotally mounted to the first extension on the back member, the second rod being pivotally mounted to a fixed point on the support structure, and the third rod being pivotally mounted to the first frontal axis on the seat member;

a footrest control mechanism, having a first end pivotally mounted to a fixed point on the support structure, a second end pivotally mounted to the second axis on the footrest member, and a pivotable joint therebetween, and further including means for causing compression between the first extension of the back member and a point on the footrest control mechanism between the pivotable joint and the fixed point on the support structure;

second means mounted between a point on the seat member and a point on the footrest member, for causing compression therebetween; and a retractable control jack operatively disposed between a first jack pivot point on the support structure and a second jack pivot point mounted on the back member, whereby the relative positions of the back member, seat member, footrest member, and support structure are variable by means of extension and retraction of the control jack.

9. A multifunction and multiposition chair which can be automatically transformed into any intermediate position between a totally recumbent position and an orthostatic position for a user of the chair, and including a support structure which receives a back, a seat and a footrest, wherein the chair comprises:

a plurality of rod assemblies linking the back, the seat, and the footrest to one another and forming a plurality of kinematic chains which are coupled with the support structure and which are operatively interconnected with one another for moving the back, the seat and the footrest into different positions relative to one another responsive to a jack, including an assembly for controlling the footrest, an assembly for controlling the seat, and an assembly for controlling the back and for maintaining the back in a vertical position, wherein the assembly for controlling the back acts on an underframe complementary to the seat, and wherein the footrest is fully retractable between intermediate sitting and vertical positions for the user, and to form an extension of the seat and the back in a horizontal position.

* * * * *